US011988061B2

(12) United States Patent
Kapoor et al.

(10) Patent No.: US 11,988,061 B2
(45) Date of Patent: May 21, 2024

(54) HYDRAULIC CONTROL LINE FILTERS FOR SUBSEA HIGH-PRESSURE APPLICATION

(71) Applicant: Oceaneering International, Inc., Houston, TX (US)

(72) Inventors: Parteek Kapoor, Haryana (IN); Sunil Prakash, Fulshear, TX (US); Amit Saini, Nabh (IN)

(73) Assignee: Oceaneering International, Inc., Houston, TX (US)

( * ) Notice: Subject to any disclaimer, the term of this patent is extended or adjusted under 35 U.S.C. 154(b) by 3 days.

(21) Appl. No.: 18/112,561

(22) Filed: Feb. 22, 2023

(65) Prior Publication Data

US 2023/0265730 A1 Aug. 24, 2023

(51) Int. Cl.
*E21B 33/035* (2006.01)
*E21B 33/076* (2006.01)

(52) U.S. Cl.
CPC ..... *E21B 33/0355* (2013.01); *E21B 33/076* (2013.01)

(58) Field of Classification Search
CPC ..... E21B 33/0355; E21B 33/076
See application file for complete search history.

(56) References Cited

U.S. PATENT DOCUMENTS 5,738,172 A * 4/1998 van Mook ..... E21B 34/10 166/344
10,633,961 B2 * 4/2020 Berle ..... F04D 13/0653

FOREIGN PATENT DOCUMENTS

WO WO-2005115583 A1 * 12/2005 ..... B01D 17/045

* cited by examiner

*Primary Examiner* — Matthew R Buck
(74) *Attorney, Agent, or Firm* — Maze IP Law, P.C.

(57) ABSTRACT

Fluid containing contaminants may be filtered using a hydraulic control line filter for subsea high-pressure application comprising a housing, an end cap disposed at a first end of the housing where the end cap defines a filter fluid connector which comprises a fluid inlet and a filtered fluid outlet, a first centralizer disposed within the housing, a sump tube disposed within the housing and centralized within the first centralizer where an outside diameter of the sump tube and an inside diameter of the housing define a sump volume annulus there-between, a filter centralizer, and a fluid filter disposed in the housing and centralized within the sump tube by the filter centralizer.

20 Claims, 3 Drawing Sheets

HYDRAULIC CONTROL LINE FILTERS FOR SUBSEA HIGH-PRESSURE APPLICATION

RELATION TO OTHER APPLICATIONS

This application claims priority through India Provisional Application 202211009426 filed on Feb. 22, 2022.

BACKGROUND

For subsea hydraulic filters, it is important to cut cost by either removing redundant features, combining features which can perform functions simultaneously, or both. In existing designs, the sump housing and filter housing are separate components and add separate costs in the assembly.

FIGURES

Various figures are included herein which illustrate aspects of embodiments of the disclosed inventions.

DESCRIPTION OF EXEMPLARY EMBODIMENTS

Figure 1:
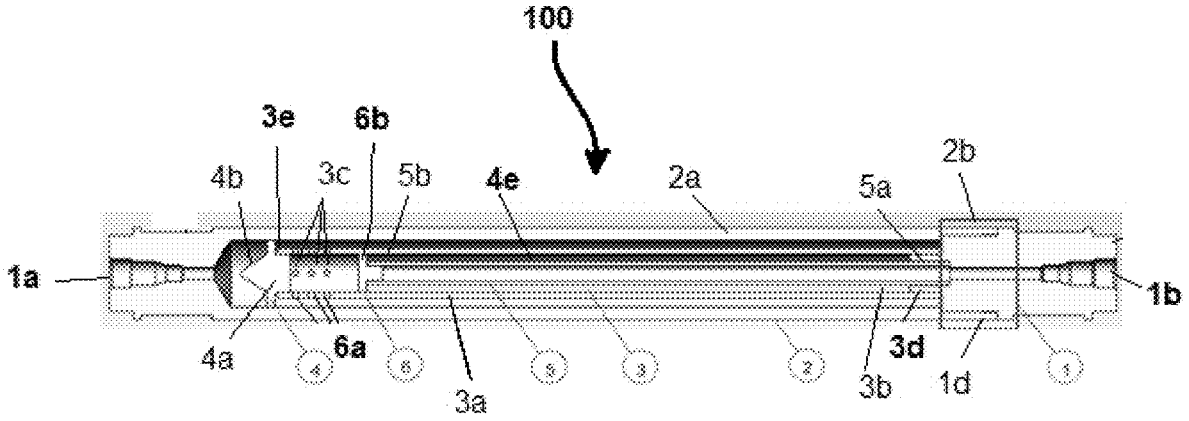
FIG. 1 is a cross-section view in partial perspective of an exemplary embodiment.

In a first embodiment, referring generally to FIG. 1, hydraulic control line filter for subsea high-pressure application 100 combines different features of previous designs into novel, single embodiment to save on cost and provide compact design. Hydraulic control line filter for subsea high-pressure application 100 is typically more compact in size due to reduced length; has less chance of leakage than current filters due to reduction in threaded joints; and has sufficient sump volume to collect fluid borne impurities before filtrations, leading to an increased filter life. Installation may benefit due to reduced number of clamps. In a preferred embodiment, hydraulic control line filter for subsea high-pressure application 100 is typically configured to filter fluid at high fluid pressure applications, e.g., fluid pressures of up to around 15,000 psi, and may be used in downhole, subsea, and surface applications.

In a preferred embodiment, hydraulic control line filter for subsea high-pressure application 100 comprises housing 2, comprising inner housing cavity 2*a* and pressurized fluid inlet 1*a*; end cap 1 disposed at first end 2*b* of housing 2, where end cap 1 comprises filtered fluid outlet 1*b*; first centralizer 4 disposed within inner housing cavity 2*a*, where first centralizer 4 comprises an inner first centralizer projection 4*a* and first centralizer cavity 4*e*; sump tube 3 disposed and centered within inner first centralizer cavity 4*e*, where sump tube 3 comprises an outer surface which, along with an inner surface of inner housing cavity 2*a*, defines sump tube cavity 3*a* there-between; and fluid filter 5 disposed in sump tube 3 and centered within sump tube 3 by filter centralizer 6, where filter centralizer 6 comprises filter centralizer projection 6*b* disposed at least partially inside filter element 5.

Sump tube 3 and fluid filter 5 are typically overlapped in housing 2 to make it integrated assembly. As described more fully below, hydraulic control line filter for subsea high-pressure application 100 uses a concentric and overlapping design of first centralizer 4 to centralize sump tube 3 inside housing 2 and uses filter centralizer 6 to centralize filter element 5 in sump tube 3.

In most embodiments, pressurized fluid inlet 1*a* is upstream of fluid flow which comprises contaminated fluid and filtered fluid outlet 1*b* is downstream of the fluid flow.

Hydraulic control line filter for subsea high-pressure application 100 typically may be mounted as needed, e.g., vertically. Typically, housing 2, first centralizer 4, sump tube 3, filter centralizer 6, and fluid filter 5 are all substantially tubular but can be any shape, e.g., ovoid or obround or the like, which can accommodate the functions and limitations described herein.

Figure 1A:
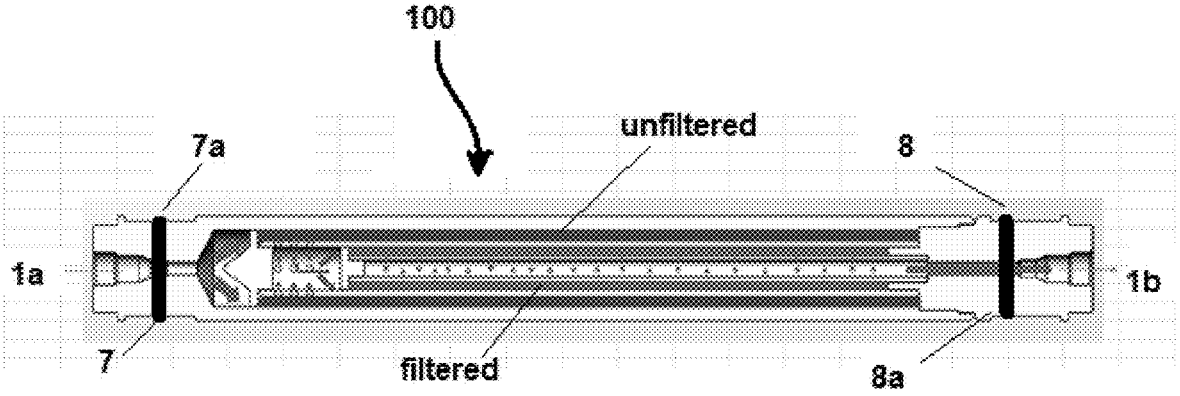
FIG. 1A is a cross-section view in partial perspective of an exemplary embodiment illustrating clamps and fluid flow.

In certain embodiments, referring additionally to FIG. 1A, first clamp 7 is disposed on or proximate to first clamp seat 7*a* and second clamp 8 is disposed on or proximate to second clamp seat 8*a*, simplifying a current design which requires three or more clamps.

End cap 1 may comprise a threaded portion, e.g., a male threaded portion, by which it can be affixed to a complementarily threaded portion of housing 2 and, as described herein, accommodates at least a portion of filter element 5 and sump tube 3.

Sump tube 3 comprises sump tube inner cavity 3*b* in fluid communication with pressurized fluid inlet 1*a* and fluid filter 5 is in fluid communication with filtered fluid outlet 1*b* and sump tube 3. In embodiments, sump tube 3 further comprises a plurality of ports 3*c*, e.g., three ports 3*c*, extending between sump tube inner cavity 3*b* and the outer surface of sump tube 3. The plurality of ports 3*c* are disposed at predefined locations, e.g., at 90° location offsets for a total of twelve ports 3*c*.

In an embodiment, first centralizer 4 comprises conical first end 4*b* which may be used to guide high pressure fluid to the periphery of first centralizer 4. In certain embodiments, first centralizer 4 comprises or is other a part of a surface control subsurface safety valve (SCSSV). For SCSSV filtration applications, hydraulic control line filter for subsea high-pressure application 100 may define an SCSSV filter and be installed in immediate proximity to the SCSSV valve.

First centralizer 4 is typically disposed at inner housing cavity 2*a* of housing 2 distally from end cap 1 and configured to guide fluid under pressure to a periphery of sump tube 3. In certain embodiments, first centralizer 4 further comprises a predefined number of slots 4*c* disposed about a periphery of first centralizer 4 through which fluid enters into sump tube cavity 3*a* or sump cavity 3*b*.

Figure 2:
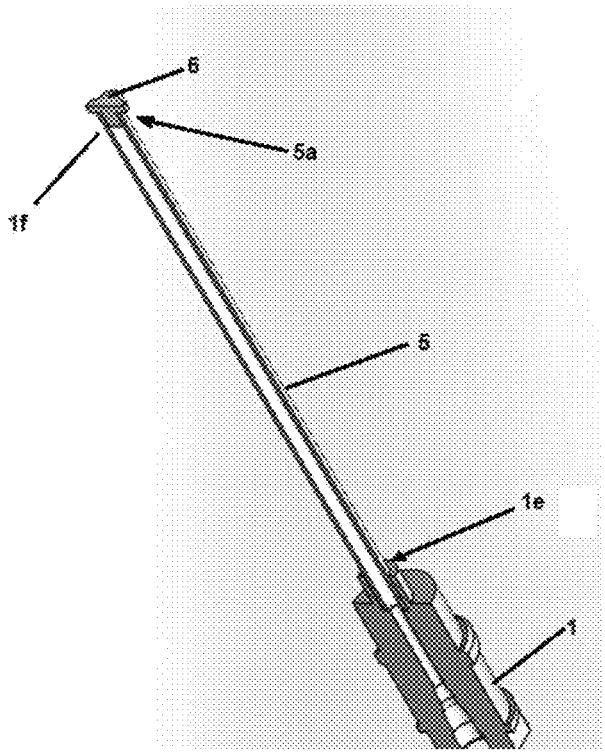
FIG. 2 is a cross-section three-dimensional view in partial perspective of an exemplary embodiment.
Figure 3:
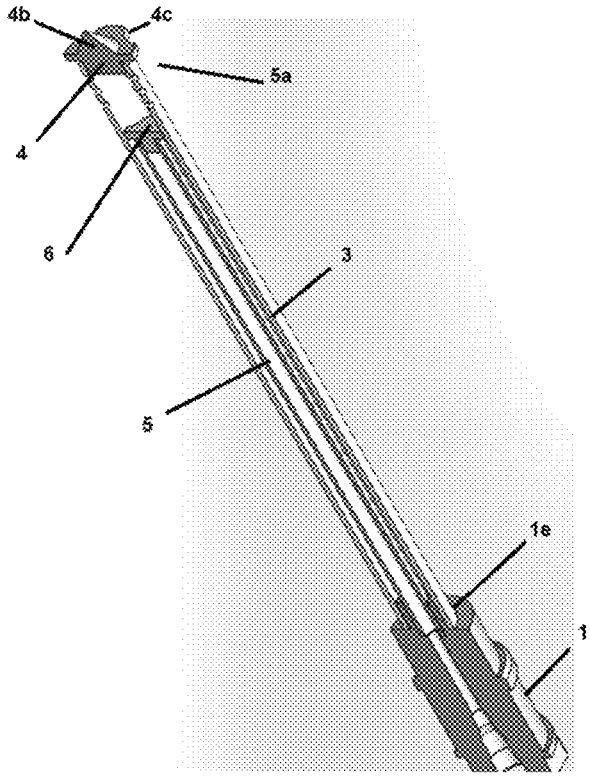
FIG. 3 is a cross-section three-dimensional view in partial perspective of an exemplary embodiment.
Figure 4:
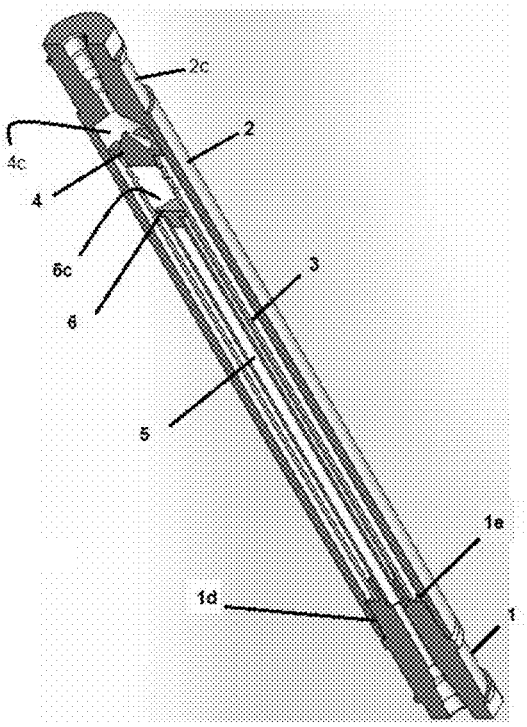
FIG. 4 is a cross-section three-dimensional view in partial perspective of an exemplary embodiment.

Referring additionally to FIG. 1A, fluid filter 5 typically further comprises fluid filter end 5*a*, by which fluid filter 5 may be welded, e.g. at weld 1*f* (FIG. 2), or otherwise attached to end cap 1, and centralizer filter end 5*b*, by which fluid filter 5 may be welded or otherwise attached to fluid centralizer 6. In certain embodiments, fluid filter 5 comprises a porous sintered metal such as 316 SS.

Fluid centralizer 6 may comprise a predetermined set of slots 6*a* on its periphery, where the predetermined set of slots 6*a* are configured to guide fluid coming from the plurality of ports 3*c* in sump tube 3 to a filtration area defined within a cavity existing between an outer surface of fluid filter 5 and sump tube inner cavity 3*b*.

In the operation of exemplary methods, referring back to FIG. 1 and FIG. 1A, contaminant containing fluid may be filtered using hydraulic control line filter for subsea high-pressure application 100, described above, by using cone 4*b* of first centralizer 4 to divert pressurized fluid to sump tube 3, allowing the pressurized fluid to collect in sump tube 3, and allowing sediments within the pressurized fluid to start settling, e.g., due to gravitational effect. Fluid with contaminants enters, e.g., at a high pressure of up to around 15,000 psi via pressurized fluid inlet 1*a* and once filtered exits via filtered fluid outlet 1*b*.

After the pressurized fluid reaches a level of a predetermined subset of a predetermined set of sump tube ports 3*c* in sump tube 3, the pressurized fluid is allowed to enter inside sump tube 3 and proceed into a filtration area via centralizer 6. Fluid filter 5 is then used to filter pressurized fluid collected in fluid filter 5 and the filtered pressurized fluid allowed to exit from an inside of fluid filter 5 through filtered fluid outlet 1*b* in end cap 1. The filtered fluid may then be allowed to transit to a surface control subsurface safety valve (SCSSV) or any other system requiring filtered fluid at high pressure.

Typically, fluid filter 5 is connected to the cap 1 and to filter centralizer 6; sump tube 3 is fitted to end cap 1, typically fitted over end cap 1, at first end 3*d* of sump tube 3 and also fitted to first centralizer 4 at second end 3*e* of sump tube 3 which is distal to first end 3*d* and housing 2 is fitted to end cap 1, typically fitted over end cap 1. In certain embodiments, end cap 1 is fitted over housing 2.

In most embodiments, housing 2 is secured to end cap 1 such as by connectors, which can be threaded connectors 1*d* comprising complimentarily threaded portions of housing 2 and end cap_1, by welding the two together, e.g., at welded connector 1*e* (FIG. 2), or the like, or a combination thereof. By way of example and not limitation, if end cap 1 and housing 2 comprise a complimentary set of threaded portions, fluid filter 5 can be connected to end cap 1 such as by one or more welds; fluid filter 5 connected to filter centralizer 6 such as by one or more welds which may comprise filet welds; sump tube 3 fitted over or otherwise connected to end cap 1 such as by one or more welds which may comprise fillet welds 1*e*; and sump tube 3 fitted to or otherwise connected to first centralizer 4 such as by welds which may comprise one or more fillet and/or bevel welds. Housing 2 is fitted over or otherwise connected to end cap 1, or end cap 1 fitted over or otherwise connected to housing 2, via threaded connectors 1*d*. In certain embodiments, a groove weld may be created between housing 2 and end cap 1 to make a seal weld.

The foregoing disclosure and description of the inventions are illustrative and explanatory. Various changes in the size, shape, and materials, as well as in the details of the illustrative construction and/or an illustrative method may be made without departing from the spirit of the invention.

The invention claimed is:

1. A hydraulic control line filter for subsea high-pressure application, comprising:

a. a housing comprising an inner housing cavity and a pressurized fluid inlet;

b. an end cap disposed at a first end of the housing, the end cap comprising a filtered fluid outlet;

c. a first centralizer disposed within the inner housing cavity, the first centralizer comprising an inner first centralizer cavity and a first centralizer portion disposed at least partially within the housing;

d. a sump tube disposed and centered within the housing, an outer surface of the sump tube and an inner surface of the inner housing cavity defining a sump tube cavity there-between, the sump tube comprising a sump tube inner cavity in fluid communication with the pressurized fluid inlet;

e. a filter centralizer disposed at least partially within the sump tube inner cavity; and f. a fluid filter disposed at least partially within the sump tube and centered within the sump tube by the filter centralizer, the fluid filter in fluid communication with the filtered fluid outlet and the sump tube, a portion of the filter centralizer at least partially disposed within the fluid filter.

2. The hydraulic control line filter for subsea high-pressure application of claim 1, wherein the hydraulic control line filter is configured to filter fluid at high fluid pressure applications of up to around 15,000 psi.

3. The hydraulic control line filter for subsea high-pressure application of claim 1, wherein the first centralizer comprises a conical first end.

4. The hydraulic control line filter for subsea high-pressure application of claim 1, wherein the hydraulic control line filter for subsea high-pressure application is a part of a surface control subsurface safety valve (SCSSV).

5. The hydraulic control line filter for subsea high-pressure application of claim 1, wherein the housing, the first centralizer, the sump tube, the filter centralizer, and the fluid filter are all substantially tubular.

6. The hydraulic control line filter for subsea high-pressure application of claim 1, further comprising a first clamp disposed on or proximate a first clamp seat and a second clamp disposed on or proximate to a second clamp seat.

7. The hydraulic control line filter for subsea high-pressure application of claim 1, wherein the end cap comprises a threaded portion.

8. The hydraulic control line filter for subsea high-pressure application of claim 1, wherein the sump tube comprises a plurality of ports extending between the sump tube inner cavity and the outer surface of the sump tube.

9. The hydraulic control line filter for subsea high-pressure application of claim 8, wherein the filter centralizer comprises a predetermined set of slots on it's a periphery of the filter centralizer, the predetermined set of slots configured to guide fluid coming from the plurality of ports in the sump tube to a filtration area defined within a cavity between an outer surface of the fluid filter and the sump tube inner cavity.

10. The hydraulic control line filter for subsea high-pressure application of claim 8, wherein the plurality of ports comprises three ports disposed at predefined locations.

11. The hydraulic control line filter for subsea high-pressure application of claim 10, wherein the predefined locations are at every 90° location for a total of twelve ports.

12. The hydraulic control line filter for subsea high-pressure application of claim 1, wherein the first centralizer is disposed at the inner housing cavity of the housing distally from the end cap where the first centralizer is configured to guide fluid under pressure to a periphery of the sump tube.

13. The hydraulic control line filter for subsea high-pressure application of claim 1, wherein the first centralizer comprises a predefined number of slots disposed about a periphery of the first centralizer through which fluid enters into the sump tube cavity.

14. The hydraulic control line filter for subsea high-pressure application of claim 1, wherein the fluid filter further comprises:

a. a fluid filter end by which the fluid filter is welded with the end cap; and b. a centralizer filter end by which the fluid filter is welded to the filter centralizer.

15. The hydraulic control line filter for subsea high-pressure application of claim 1, wherein the fluid filter comprises a porous sintered metal (316 SS).

16. The hydraulic control line filter for subsea high-pressure application of claim 1, wherein:

a. the pressurized fluid inlet is upstream of fluid flow comprising contaminated fluid; and b. the filtered fluid outlet is downstream of the fluid flow.

17. A method of filtering a fluid using a hydraulic control line filter for subsea high-pressure application, comprising a housing which comprises an inner housing cavity and a pressurized fluid inlet, an end cap disposed at a first end of the housing where the end cap comprises a filtered fluid outlet, a first centralizer disposed within the inner housing cavity where the first centralizer comprises an inner first centralizer cavity and a first centralizer portion disposed at least partially within the housing, a sump tube disposed and centered within the housing, an outer surface of the sump tube and an inner surface of the inner housing cavity defining a sump tube cavity there-between, where the sump tube comprises a sump tube inner cavity in fluid communication with the pressurized fluid inlet, a filter centralizer disposed at least partially within the sump tube inner cavity, and a fluid filter disposed at least partially within the sump tube and centered within the sump tube by the filter centralizer where the fluid filter is in fluid communication with the filtered fluid outlet and the sump tube and a portion of the filter centralizer is at least partially disposed within the fluid filter, the method comprising:

a. accepting pressurized fluid via the pressurized fluid inlet;

b. using the first centralizer to divert the pressurized fluid to the sump tube;

c. collecting the pressurized fluid in the sump tube;

d. allowing sediments present within the pressurized fluid to start settling due to gravitational effect;

e. after the pressurized fluid reaches to a level of a predetermined subset of a predetermined set of sump tube ports in the sump tube, allowing the pressurized fluid to enter inside the sump tube and proceed into a filtration area via the filter centralizer;

f. using the fluid filter to filter pressurized fluid collected in the fluid filter; and g. allowing the filtered, pressurized fluid to exit an inside of the fluid filter through the filtered fluid outlet in the end cap.

18. The method of claim 17, wherein:

a. the fluid filter is connected to the end cap and to the filter centralizer;

b. the sump tube is fitted over the end cap at a first end of the sump tube and fitted to the first centralizer at an end of the sump tube distal to the first end of the sump tube; and a. the housing is fitted over the end cap.

19. od of claim 17, wherein the end cap and the housing comprise a complementary set of threaded connectors, the method further comprising:

a. connecting the fluid filter to the end cap by a weld;

b. connecting the fluid filter to the filter centralizer by a weld;

c. fitting the sump tube over the end cap via a weld;

d. fitting the sump tube to the first centralizer via a weld;

e. fitting the housing over the end cap via the complementary set of threaded connectors; and f. creating a groove weld between the housing and the end cap to make a seal weld.

20. The method of claim 17, wherein the first centralizer comprises a conical first end, the method further comprising using the conical first end to divert pressurized fluid to the sump tube.

* * * * *